US005778805A

United States Patent [19]

Green

[11] Patent Number: 5,778,805

[45] Date of Patent: Jul. 14, 1998

[54] VEHICLE SECURITY VAULT WITH ELECTRONIC LOCK

[76] Inventor: John Richard Green, 6331 Mesa Court, Burnaby, British Columbia, Canada, V5E 3W4

[21] Appl. No.: 738,436

[22] Filed: Oct. 25, 1996

[51] Int. Cl.[6] ..... E05B 49/00

[52] U.S. Cl. ..... 109/51; 70/278; 70/333 A; 70/465

[58] Field of Search ..... 109/51, 6, 7; 70/333 A, 70/258, 279, 278, 445, 446, 465

[56] References Cited

U.S. PATENT DOCUMENTS

| | | | |
|---|---|---|---|
| 3,831,408 | 8/1974 | Featherunan | 70/278 X |
| 4,083,424 | 4/1978 | von den Stemmen et al. | 70/278 X |
| 4,524,904 | 6/1985 | Masse et al. | 232/7 |
| 4,669,394 | 6/1987 | Fogleman et al. | 70/278 X |
| 4,741,275 | 5/1988 | Lewiner et al. | 107/7 |
| 4,887,445 | 12/1989 | Beatty | 70/278 |
| 4,898,010 | 2/1990 | Futami et al. | 70/257 X |
| 4,926,762 | 5/1990 | Paul | 109/51 |
| 5,056,342 | 10/1991 | Prinz | 109/51 X |
| 5,164,718 | 11/1992 | Cedergren | 340/825.31 |
| 5,199,361 | 4/1993 | Robinson | 109/51 |
| 5,389,919 | 2/1995 | Warren et al. | 70/278 X |
| 5,595,081 | 1/1997 | Nuzzo et al. | 70/446 |

*Primary Examiner*—Lloyd A. Gall
*Attorney, Agent, or Firm*—John Russell Uren

[57] ABSTRACT

A security vault used to secure valuables. The vault has an outer case and an interior. A movable panel member allows access to the interior. A locking mechanism operable by a programmable electronic circuit allows the panel member to be opened. A keypad is operable to provide a security code to the programmable electronic circuit. The keypad may be one or two, the first being located outside the vault and connected to the programmable electronic circuit. The second keypad may be located in the interior of the outer case. Either keypad may be used to provide the security code. The second keypad is used if damage occurs to the first keypad and is accessible from exterior of the security vault.

8 Claims, 5 Drawing Sheets

VEHICLE SECURITY VAULT WITH ELECTRONIC LOCK

INTRODUCTION

This invention relates to an apparatus for securing items and valuables in a vehicle and, more particularly, to a vehicle security vault for securing vehicular valuables.

BACKGROUND OF THE INVENTION

Vaults and lock boxes are a common means of securing one's valuables. For example, valuables may be secured in a safety deposit box or in safes. However, valuables transported in vehicles do not have these measures available to protect valuables from "smash and grab" vehicle robberies. Stereos, compact discs, cellular phones, purses, cameras, and similar valuables may be at risk.

Although car alarms are available, a "smash and grab" thief may not be deterred since a vehicle door lock may be quickly punched out or a window may be broken in order to grab any valuables within reach.

Valuables are also commonly placed in the glove compartment of a vehicle. Glove compartments, however, offer limited storage space and structural integrity is lacking. A locked glove compartment can be broken into easily with a crowbar or screwdriver.

Valuables may also be stored in vehicle trunks. However, many vehicles such as pickup trucks, minivans, and hatchbacks lack such trunks. Further, a thief can obtain access to the trunk without considerable difficulty.

U.S. Pat. 4,926,762 entitled SECURITY SAFES FOR VEHICLES (Paul) teaches two embodiments of a lightweight security safe for use in vehicles. A twelve (12) gauge thick steel boxlike housing with welded seams is disclosed. A rectangular steel tubing framework around the access opening provides reinforcement around the locked door and a strong location to mount a full length piano type door hinge. Each door and hinge is slightly recessed to prevent thieves from prying on the edges of the door. Paul further teaches a heavy duty combination lock mounted on the back of the door for locking an accessible door handle and handle rod. A crank-and-rod system is attached to the handle assembly in the interior of the door. The crank-and-rod assembly is further attached to, and actuates a multiple of lock pins extendable from two oppositely disposed edges of the door. Further, the safe is lined in the interior with a first layer of fire-resistant mineral fiber material, covered with a layer of carpet.

However, Paul contemplates a nonremovable apparatus, securely bolted to the vehicle with carriage bolts. The safe cannot be readily removed and placed at another location. Further, the safe door must be manually locked after the door is closed.

SUMMARY OF THE INVENTION

According to the invention, there is provided a security vault comprising an outer case, an interior within said outer case, a panel member movable relative to said outer case and allowing access to said interior, a programmable electronic circuit for allowing said panel member to be opened relative to said outer case, a locking member operable by said programmable electronic circuit to maintain said panel member in a closed position relative to said case and to allow said panel member to be opened relative to said outer case and a first key pad to enter a security code readable by said programmable electronic circuit.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
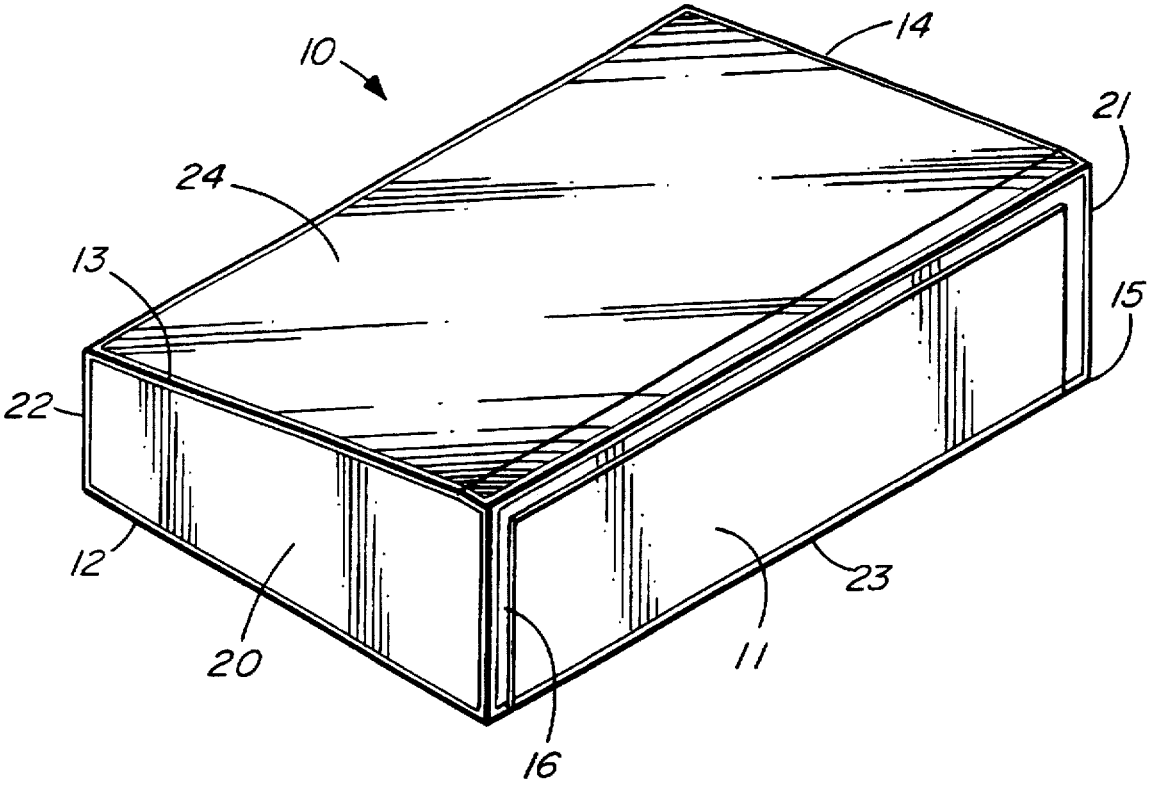
FIG. 1 is a diagrammatic isometric view of the vehicle security vault according to the present invention.

Referring now to the drawings, FIG. 1 illustrates a fabricated metal vehicle security vault generally illustrated at 10 and a recessed steel vault door 11 is provided and opens and closes to allow access to the interior of the vault 10. The fabricated metal security vault 10 is fully welded on all corners 12, 13, 14, 15 and is one-sixteenth (1/16) of an inch in thickness. The steel door 11 is one-eighth (1/8) of an inch thick, and is reinforced with a square steel door frame 16.

The inside dimensions of the security vault 10 are conveniently approximately twenty-seven (27) inches by seventeen (17) inches by five (5) inches.

Figure 2A:
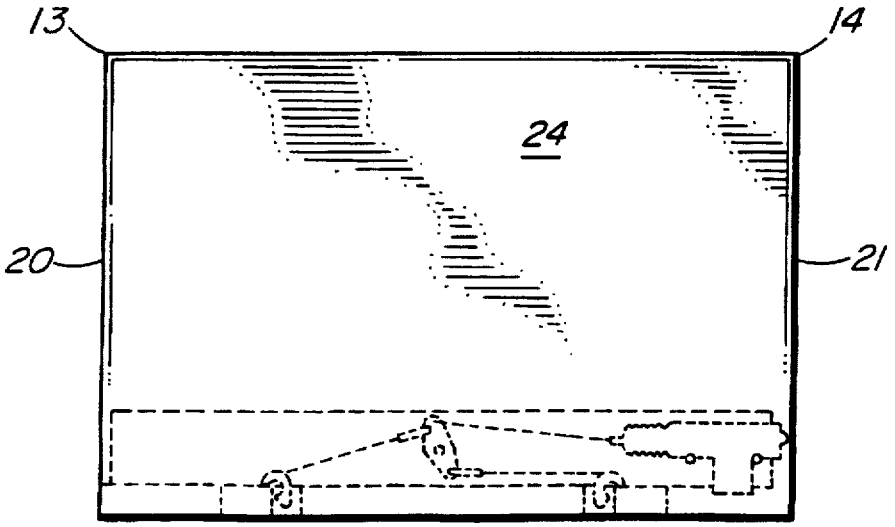
FIGS. 2A, 2B and 2C are, respectively, plan, front and side views of the internal door actuating mechanism of the security vault according to the invention.
Figure 2B:
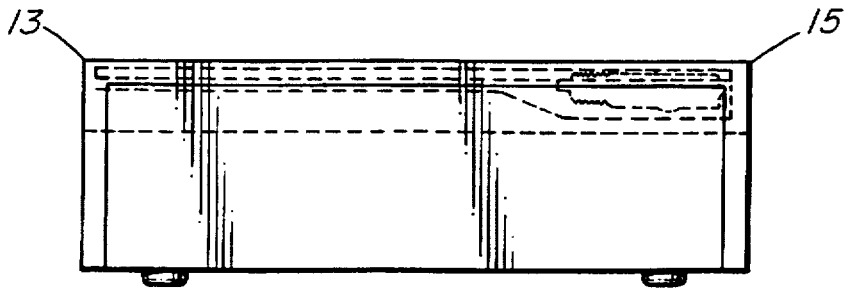
Figure 2C:
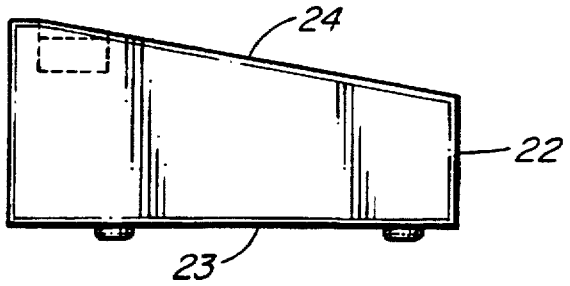
Figure 3:
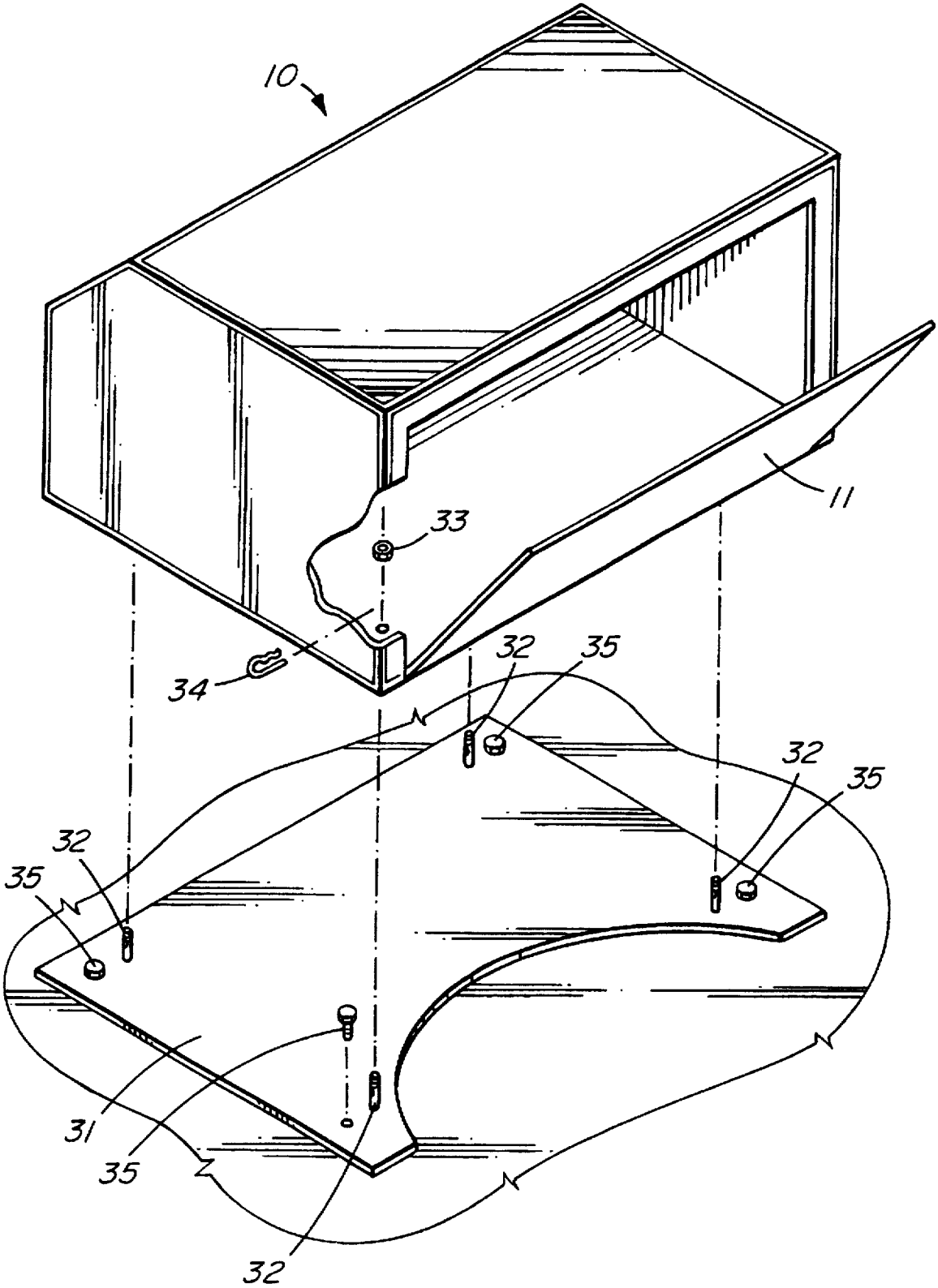
FIG. 3 is a diagrammatic isometric view of the mounting mechanism of the security vault according to the invention.

The exterior dimensions of the security vault 10 are shown in FIG. 2. Side panels 20, 21 are parallel and perpendicular to back panel 22. Back panel 22 is parallel to the hinged openable vault door 11 on the front of the security vault 10 (FIG. 3). Bottom panel 23 is perpendicular to the side panels 20,21. Top panel 24 is not parallel to the bottom panel 23 as clearly seen in FIG. 1. Top panel 24 slopes to make more efficient use of the space under the seats of mini-vans where the vault 10 is intended to be located (FIG. 2). The vault 10 may be manufactured in other geometries to more efficiently use the space available at other potential mounting locations. For example, the vault 10 illustrated in FIG. 3, without a gradually sloping top panel 24, is specifically designed to be mounted in trucks.

Vehicle security vault 10 is mounted on a mounting plate 31. Mounting plate 31 is attached to the vehicle, as illustrated in FIG. 3, using mounting bolts 35. Mounting plate 31 and vault 10 may be located under the back seat of minivans, in the trunk of vehicles, or in any other convenient location. Mounting bolts 35 securing mounting plate 31 to the vehicle are only exposed when the security vault 10 is removed.

The vehicle security vault is removable, provided that the user can open the vault 10. Mounting studs 32 holding the security vault 10 to the mounting plate 31 are accessible when the vault door 11 is open. Mounting studs 32 may be cross drilled to utilize quick release fasteners 34 rather than conventional threaded fasteners 33. Quick release fasteners 34 permit convenient removal of the security vault 10 to another mounting plate 31 at a different location.

Figure 5:
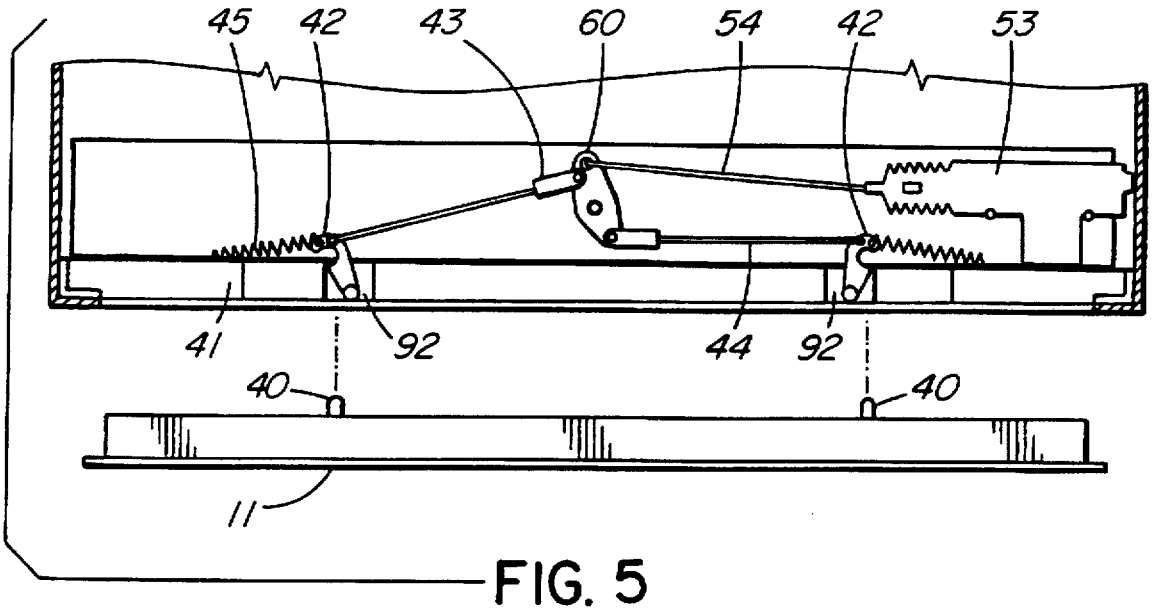
FIG. 5 is a diagrammatic view of the pull-only link and clevis assembly for the door of the security vault.
Figure 6A:
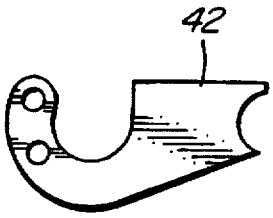
FIGS. 6A and 6B are, respectively, detail views of the latch hook and toggle plate according to the invention.
Figure 6B:
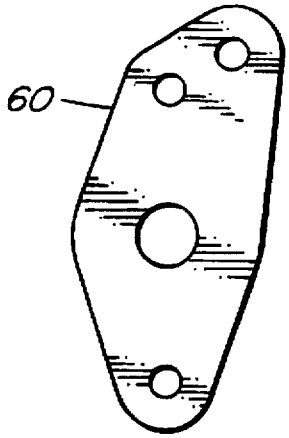
Figure 7A:
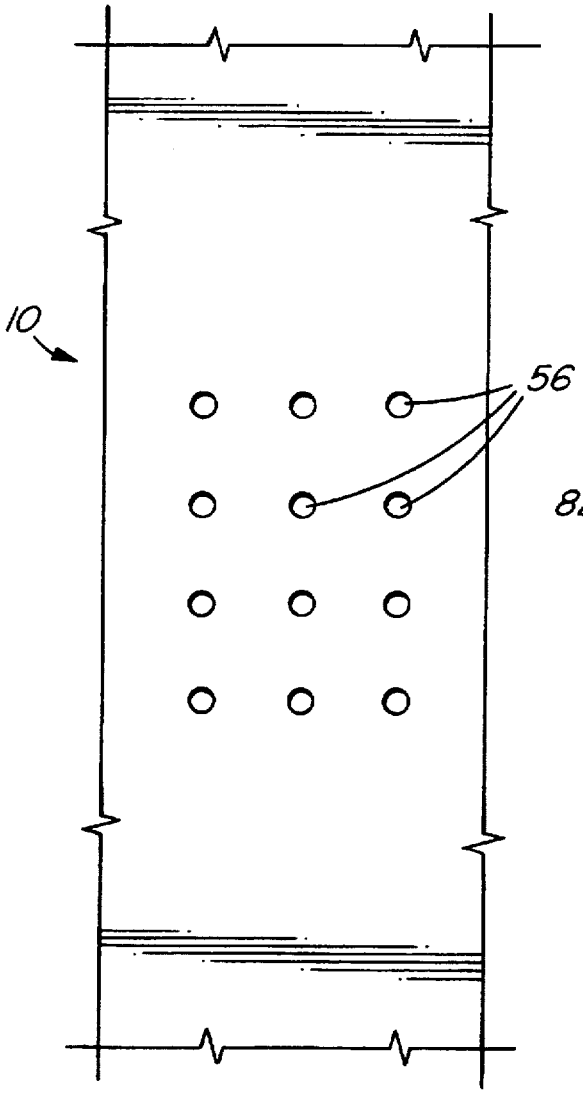
FIG. 7 is a diagrammatic view of the internal secondary keypad mounting in the vehicle security vault face.
Figure 7B:
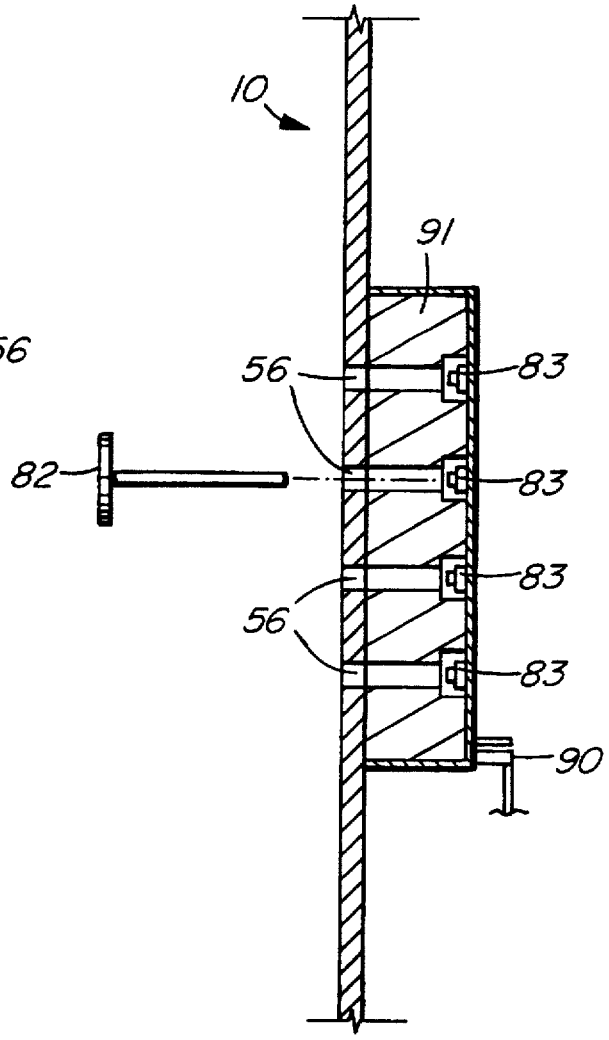

When the recessed vault door 11 is closed, two door-mounted pins 40 (FIG. 5) pass through slots in the lock block 41. The latch hooks 42 (which are normally held in the closed position by light springs 45) are rotated by the door pins 40. Link and clevis assemblies 43,44 are attached to the latch hooks 42. When the vault door 11 is fully closed, latch hooks 42 are biased to the closed position by light springs 45, thereby engaging the door pins 40.

Figure 4:
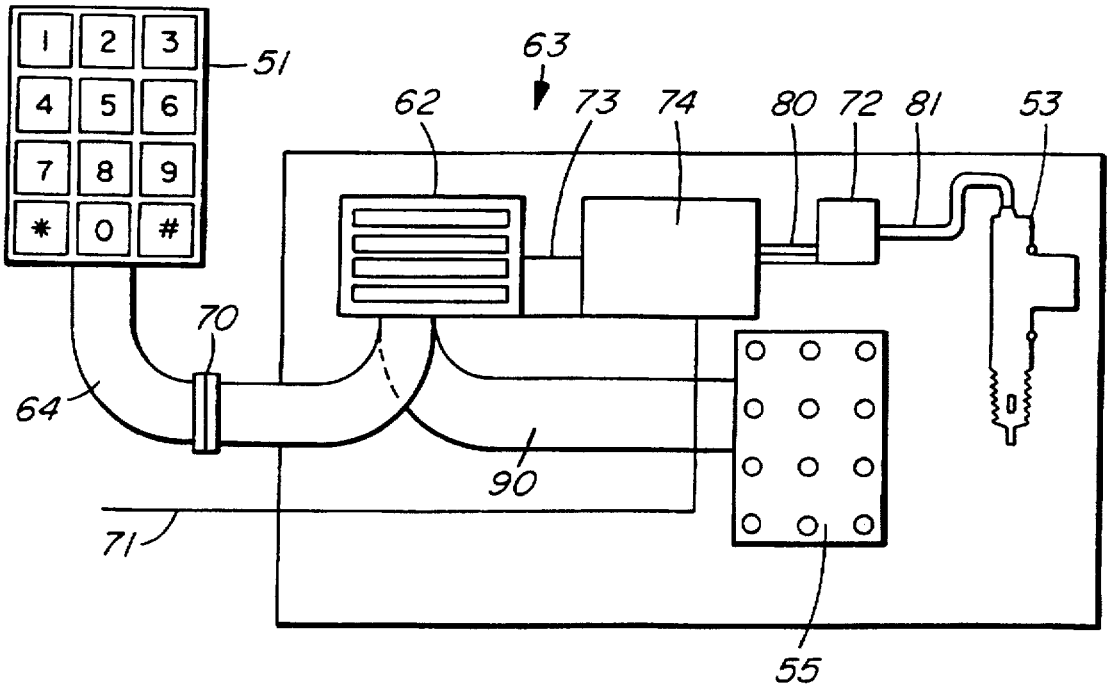
FIG. 4 is a diagrammatic illustration of the keypad, code selector array, and the door actuator used for the security vault of the invention.

An electronic lock code sequence is used to open the locked security vault 10. Code sequence can be determined by the user selecting switches on the code selector array 62 corresponding to numbers on the key pad 51 (FIG. 4). All electronics are securely contained within the security vault 10.

An individual attempting to access the vehicle security vault 10 must first activate power to turn the unit on. Power can only reach the solenoid door actuator 53 after the electronic switching circuit has been activated. The user then enters the code sequence into the externally located keypad 51. Keypad 51 may be externally mounted on the security vault 10 or located elsewhere in the vehicle. Keypad 51 is connected to electronic components in the interior of the security vault 10 by a data-only, multi-wire cable 64 with a quick connector 70. If keypad 51 is vandalized, the quick connector 70 permits replacement.

In the event keypad 51 is disabled, an internally mounted secondary keypad 55 can be used. Secondary keypad 55 is mounted on the interior of the back panel 22. Secondary keypad 55 is only accessible through small keypad guide holes 56 in the security vault 10 casing. The guide holes 56 are concealed under a label. A thin plunger 82 is required to depress the secondary keypad switches 83 through the multitude of keypad guide holes 56. Secondary keypad control lines 90 lead to the code selector array 62.

Quick connector 70 and data-only multi-wire cable 64 connect to the code selector array 62 so vault door 11 cannot be activated by connecting power to individual wires. Further, the sole power wire 71 supplying the security vault 10 also powers the relay 72 to the solenoid door actuator 53. Severing the power wire 71 would ensure that the vault door 11 will not open.

When the code is correctly entered, an electronic circuit is activated (FIG. 4). Signals from the keypad 51 are filtered by the code selector array 62. The electronic code must be entered correctly, or the keypad 51 (or secondary keypad 55) resets and the entire code must be re-entered. Further, the user must enter the code in a limited amount of time, or the keypad 51 (or secondary keypad 55) resets and the user must re-enter the entire code. Filtered signals from the code selector array 62 pass through the code control lines 73 into the central control unit 74. The central control unit 74 utilizes integrated circuit technology to activate a relay 72 through the relay control lines 80. Once activated, the relay 72 activates the solenoid door actuator 53 via the actuator control lines 81.

To open the vault door 11, solenoid door actuator 53, activated by the electronic circuit, pulls on an attached rod 54 for a very short period. The resulting solenoid motion causes rod 54 to rotate the attached toggle 60 and pulls both link and clevis assemblies 43,44 pulling the latch hooks 42 out of the path of the door pins 40. A door spring (not illustrated) is conveniently mounted on the face of the vault door 11 to push the door pins 40 past the latch hooks 42 and allows the vault door 11 to fall open fully. A pneumatic strut (not illustrated) may be attached to the vault door 11 and the lock box 10 prevents the vault door 11 from opening abruptly and causing injury.

OPERATION

In operation, the fabricated metal vehicle security vault 10 is mounted in a vehicle. A user places valuables inside vehicle security vault 10 upon leaving the vehicle. The vault door 11 is shut, thereby locking the vehicle security vault 10.

A thief attempting to pry open the vehicle security vault 10 will find that the durable metal construction of the vault 10 resists such conventional methods of intrusion. Recessed vault door 11 and steel door frame 16 resist attempts to pry open the vault 11.

A thief attempting to circumvent keypad 51 access may vandalize keypad 51 and connect power to the attached multi-wire cable 64. The multi-wire cable 64 exclusively conveys data, so a thief cannot activate the door 11 in this manner. A thief may sever the power wire 71 to the vault 10, but without power the vault door 11 will not open.

When the user returns to the vehicle, a code is entered on the keypad 51. The code must be entered correctly, in a limited or predetermined period of time, or the keypad 51 resets and the code must be re-entered. In the event the keypad 51 has been vandalized, the user may enter the code on the secondary keypad 55, using a thin plunger 82. The secondary keypad 55 is mounted inside the security vault 10, on the back panel 22. The secondary keypad 55 is only accessible through keypad guide holes 56 in the vault 10 casing. To avoid detection by thieves, the secondary keypad 55 is conveniently concealed beneath a label (not illustrated).

When the code is successfully entered, the security vault 10 opens and the user may retrieve the items stored inside.

Alternatively, while the vehicle security vault 10 is primarily intended to be located within a vehicle, the vault 10 and mounting plate 31 may be placed at locations other than within a vehicle.

Further, while quick release fasteners 34 are contemplated to secure the vehicle security vault 10 to the mounting plate 31 by way of mounting studs 32, conventional threaded fasteners 33 may alternatively be used.

While the secondary keypad 55 is conveniently mounted on the interior of the back panel 22 of the vault 10, it could be positioned in other locations as well, such as the top panel 24 or side panels 20,21 of the vault 10.

While a specific embodiment of the invention has been described, it will be understood that such description is illustrative of the invention only and not as limiting its scope as defined in accordance with the accompanying claims.

I claim:

1. A portable security vault comprising a case having an exterior, an interior within said case, a panel member movable relative to said case and allowing access to said interior through a first access opening, a programmable electronic circuit having a security code for allowing said panel member to be opened relative to said case, a locking member operable by said programmable electronic circuit to maintain said panel member in a closed position relative to said case and to allow said panel member to be opened relative to said case, a first key pad to enter a security code readable by said programmable electronic circuit, said first key pad being located outside of said case and being operably connected to said programmable electronic circuit, a lock enabler located wholly within said interior of said case when activated, said lock enabler being electrically connected to said locking member, and a second access opening in said case to allow access to said lock enabler from said exterior of said case.

2. Security vault according to claim 1 wherein said lock enabler is a second key pad operable to enter a security code.

3. Security vault according to claim 1 and further comprising a locking plate attachable to said security vault, said security vault being removably connected to said locking plate.

4. Security vault according to claim 3 and further comprising fasteners to removably connect said security vault to said locking plate.

5. Security vault as in claim 4 wherein said locking plate is operably connectable to a vehicle.

6. Security vault according to claim 4 wherein said fasteners are located in said interior of said case.

7. Security vault according to claim 6 wherein said fasteners are quick connect fasteners.

8. Security vault according to claim 1 wherein said second access opening allows access to said lock enabler with a tool of predetermined configuration.

* * * * *